US010696439B2

(12) United States Patent
Gotthelf et al.

(10) Patent No.: US 10,696,439 B2
(45) Date of Patent: Jun. 30, 2020

(54) CASSETTE FOR USE IN A FILLING AND/OR SEALING MACHINE

(71) Applicant: Primodan A/S, Vipperød (DK)

(72) Inventors: Finn Bang Gotthelf, Grevinge (DK); Thomas Loose, Gislinge (DK); Jørgen Henriksen, Hvalsø (DK)

(73) Assignee: Primodan A/ S, Vipperød (DK)

( * ) Notice: Subject to any disclaimer, the term of this patent is extended or adjusted under 35 U.S.C. 154(b) by 267 days.

(21) Appl. No.: 15/532,919

(22) PCT Filed: Dec. 3, 2015

(86) PCT No.: PCT/DK2015/050378
§ 371 (c)(1),
(2) Date: Jun. 2, 2017

(87) PCT Pub. No.: WO2016/086946
PCT Pub. Date: Jun. 9, 2016

(65) Prior Publication Data

US 2017/0341796 A1 Nov. 30, 2017

(30) Foreign Application Priority Data

Dec. 4, 2014 (DK) ..... 2014 70762

(51) Int. Cl.
*B65B 59/00* (2006.01)
*B65B 43/52* (2006.01)
(Continued)

(52) U.S. Cl.
CPC ..... *B65B 59/005* (2013.01); *B65B 7/2878* (2013.01); *B65B 43/52* (2013.01); *B65B 43/54* (2013.01); *B65B 3/00* (2013.01)

(58) Field of Classification Search
CPC ..... B65B 3/00; B65B 7/2878; B65B 43/52; B65B 43/54; B65B 59/005; B65G 17/32
(Continued)

(56) References Cited

U.S. PATENT DOCUMENTS 2,105,795 A * 1/1938 Risser ..... B08B 9/32 198/803.15
2,698,076 A * 12/1954 Nilsson ..... B65B 43/54 198/803.11
(Continued)

FOREIGN PATENT DOCUMENTS

DE 103 55 083 A1 7/2005
DE 102008048212 A1 3/2010
(Continued)

OTHER PUBLICATIONS

International Search Report for PCT/DK2015/050378 dated Feb. 22, 2016, 5 pages.

*Primary Examiner* — Stephen F. Gerrity
(74) *Attorney, Agent, or Firm* — Knobbe Martens Olson & Bear LLP

(57) ABSTRACT

The present invention relates to a device comprising a cassette (1) having an opening (2) in an axial direction of the cassette (1) and a support surface (3) transverse to the axial direction and extending around the opening (2) of the cassette (1), the cassette (1) being capable of receiving a cup in the opening with a outwardly extending flange of the cup supported by the support surface (3), and a supporting plate (4) having an opening in a normal direction of the supporting plate (4), wherein the cassette (1) comprises a resilient or flexible material, and a slot in which a part of the supporting plate (4) is received in close contact without cavities.

15 Claims, 2 Drawing Sheets

(51) Int. Cl.
*B65B 43/54* (2006.01)
*B65B 7/28* (2006.01)
*B65B 3/00* (2006.01)

(58) Field of Classification Search
USPC ..... 53/282, 329.3, 329.4; 198/803.3, 803.8, 198/803.14, 803.15, 867.02, 867.06, 198/867.11, 867.12
See application file for complete search history.

(56) References Cited

U.S. PATENT DOCUMENTS

| | | | | | |
|---|---|---|---|---|---|
| 3,186,142 | A | | 6/1965 | Borgardt et al. | |
| 3,199,552 | A | * | 8/1965 | Nordfors | B65B 43/54 198/803.8 |
| 3,372,081 | A | | 3/1968 | Hurschman | |
| 3,587,829 | A | * | 6/1971 | Sorensen | B65B 43/52 198/867.12 |
| 3,759,013 | A | | 9/1973 | Zimmermann | |
| 3,817,816 | A | * | 6/1974 | Watt | B65B 7/2878 53/329.3 |
| 4,188,768 | A | * | 2/1980 | Getman | A23G 9/288 53/282 |
| 4,852,328 | A | | 8/1989 | Culpepper et al. | |
| 4,909,022 | A | | 3/1990 | Kubis et al. | |
| 2014/0314983 | A1 | | 10/2014 | Matus, Jr. et al. | |

FOREIGN PATENT DOCUMENTS

| | | |
|---|---|---|
| EP | 0 786 405 A1 | 7/1997 |
| FR | 2 459 177 A1 | 1/1981 |

* cited by examiner

CASSETTE FOR USE IN A FILLING AND/OR SEALING MACHINE

CROSS REFERENCE TO RELATED APPLICATIONS

This application is a U.S. National Phase Application of PCT International Application Number PCT/DK2015/050378, filed on Dec. 3, 2015, designating the United States of America and published in the English language, which is an International Application of and claims the benefit of priority to Danish Patent Application No. PA 2014 70762, filed on Dec. 4, 2014. The disclosures of the above-referenced applications are hereby expressly incorporated by reference in their entireties.

FIELD OF THE INVENTION

The invention relates to cassettes used in packing machines mainly in the food processing industry.

BACKGROUND OF THE INVENTION

Many different food products are packed in ready made plastic cups which on top of heat sealed aluminium or plastic lids have cover lids (snap on lids) which are locked around the top part of the cups.

In order to apply the cover lids to the cups it is necessary to lift the cups from the turntable in rotating machines or lamellas in straight line machines, this is done in cassettes which are inserted in holes in the supporting plates, see FIG. 1.

The cassettes are known to have been made from aluminium or stainless steel. In recent years the trend has been towards stainless steel cassettes as steadily increasing demands for hygienic production has led to the use of more and more aggressive cleaning agents, which have a bad effect on aluminium parts.

30 Most cups used for packing of food products are produced by vacuum forming from heated plastic sheets as this type of cups are low cost compared to injection moulded cups. But the vacuum forming process does not ensure that the sealing rims of the cups have the same thickness all around.

35 The plane surfaces of the top of the metallic cassettes and of the heating plates cannot compensate for the difference in thickness, for that reason in prior art rubber rings have been known to be inserted in the metallic cassettes extending above the metallic surface making a flexible support under the rim of the cup, see FIG. 2.

From a hygienic point of view, metallic cassettes are not a good solution as there will always be a cavity between the cassettes and the supporting plate which cannot be properly cleaned.

To overcome this problem it is known that for a straight line machine the lamellas with cassettes have been milled from blocks of stainless steel, this solves the hygienic problem but is an extremely costly process.

Another disadvantage with the purely metallic cassettes is the noise created by the heating surface being brought at high speed against an unyielding surface. Packing machines are often built to handle cups with different top sections, in the dairy industry most machines are built to operate with round cups with top diameters 95 or 75 mm. The industry is interested in equipment with shortest possible time lost when changing from one cup size to the other.

To meet this demand machines have been built where the lamella with cassettes are lifted off the machines conveyor chains into a magazine, and other lamellas with cassettes for the other cup size are lowered from another magazine onto the conveyor chains. Such a system adds enormously to the price of the machine as well as representing down-time where no production is carried out.

An example on a method and a device used previously are shown in U.S. Pat. No. 3,759,013 which discloses a method and apparatus for sealing aluminum containers comprising a plurality of annular cup retaining inserts mounted in rows and columns on a conveyor-like platform, each insert having a resilient sealing ring with substantially L-shaped cross-section fixedly attached to its upper surface and extending vertically downward along the internal vertical wall of the insert. A row of heat sealing heads, each having a horizontally disposed heat sealing face located at its lower extreme, is located above the conveyor-like platform, and each heat sealing head is concentrically aligned with and immediately above a correspondingly positioned container and insert at the sealing station.

Hence, an improved cassette would be advantageous, and in particular a more efficient and/or reliable system for handling cups would be advantageous.

OBJECT OF THE INVENTION

An object of the present invention is to provide an alternative to the prior art.

In particular, it may be seen as a further object of the present invention to provide a device that solves the above-mentioned problems of the prior art with respect to noise, costs and/or down-time.

SUMMARY OF THE INVENTION

Thus, the above-described object and several other objects are intended to be obtained in a first aspect of the invention by providing a device comprising

- a cassette having an opening in an axial direction of the cassette and a support surface transverse to the axial direction and extending around the opening of the cassette, the cassette being capable of receiving a cup in the opening with a outwardly extending flange of the cup supported by the support surface, and
- a supporting plate having an opening in a normal direction of the supporting plate, wherein the cassette comprises

- a resilient or flexible material, and
- a slot in which a part of the supporting plate is received in close contact without cavities.

The object of the invention is accomplished by a cassette produced from a 30 resilient or flexible material such as for instance rubber, see FIG. 3. The cassette can be dimensioned to have a firm grip on the supporting plate leaving no cavities where bacteria can multiply due to lack of cleaning. At the same time, the resilient or flexible material will support the welding surface of the rim of the cup, eliminating the risk of leakages due to the unevenness of the rim thickness. The 35 noise level will be minimized. The price of the cassette will be much lower compared to a corresponding stainless steel cassette. A further advantage is that it will be very easy in this type of cassette to insert another cassette for a cup with a smaller top size than the initial cup. In FIG. 4 is shown how such a set of cassettes could be shaped. Such a system cassette-in-cassette (CIC) can easily be arranged for automatic shift from one cup size to another, by introducing an automatic stacker/destacker (such as the dispenser shown in FIG. 6) in a packing and/or filling machine in front of the cup dispenser.

In the present context, words are used in meaning being ordinary to the skilled person. However, the meaning of some of these terms are detailed below:

Cassette is used to indicate an element holding a cup or container and forming a support for the cup or container during filling and sealing with a lid.

Reducing cassette is used to indicate an element having the same function of a cassette and which is used to reduce the opening of the cassette when received in a cassette.

Filling machine is used to indicate a machine in which cups or containers are filled with a substance and a lid is applied to close the cups or container.

Resilient or flexible material is used to reference a material being resilient or flexible. Preferred examples of a suitable material are rubber, silicone, plastic or combinations thereof.

Thereby cassette which will overcome or at least mitigate problems encountered with cassettes according to the prior art is provided.

In a second aspect, the invention relates to a dispenser for dispensing reducing 30 cassette.

In a third aspect, the invention relates to a filling device.

Further embodiments and aspects of the present invention is disclosed in the 35 following as well as in the accompanying claims and figures.

BRIEF DESCRIPTION OF THE FIGURES

The present invention will now be described in more detail with reference to the accompanying figures. The figures show ways of implementing the present invention and are not to be construed as being limiting to other possible embodiments falling within the scope of the attached claim set. All figures are shown as cross sectional views.

DETAILED DESCRIPTION OF PREFERRED EMBODIMENTS

Figure 1:
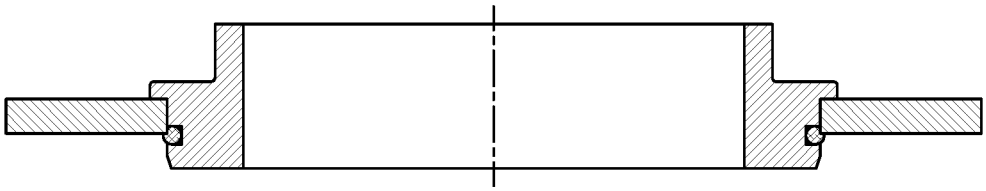
FIG. 1 (Prior Art)
FIGS. 1 and 2 each shows a prior art cassette.
Figure 2:
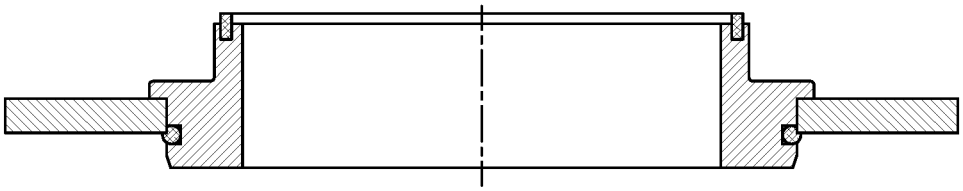
FIG. 2 (Prior Art)
Figure 3:
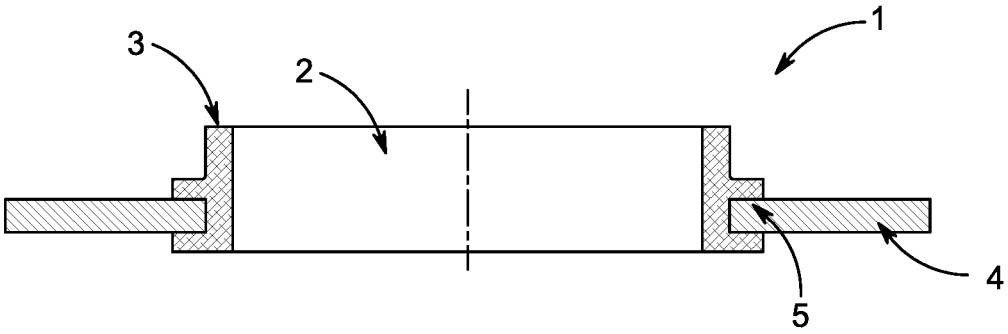
FIG. 3 shows preferred embodiment of a cassette according to the present invention.

Reference is made to FIG. 3 which shows a device comprising a cassette 1 in a 25 supporting plate 4. As will be disclosed in further details below, the device shown in FIG. 3 may for instance be a part of a filling machine and, in particular, the supporting plate 4 may be a part of a conveyer of such a filling machine.

As shown in FIG. 3, the cassette 1 has an opening 2 in an axial direction of the 30 cassette and has a support surface 3 transverse to the axial direction and extending around the opening 2 of the cassette 1. Thereby the cassette 1 being capable of receiving a cup (not shown) in the opening 2 with an outwardly extending flange of the cup supported by the support surface 3.

The device further comprising a supporting plate 4 having an opening in a normal direction of the supporting plate; as shown in FIG. 3, the cassette 1 is received in this opening.

The cassette comprises a resilient or flexible material. Typically and as shown in FIG. 3, the cassette is formed solely from such resilient or flexible material. Rubber is a preferred option for use of flexible material.

In order to maintain the cassette in the supporting plate, the cassette 1 comprising a slot 5 in which a part of the supporting plate 4 is received. It is preferred to dimension the slot 5 relatively to the thickness of the supporting plate 4 so that the supporting plate 4 is received in the slot in close contact without cavities. This at least mitigates the risk of build-up of contaminations in the slot 5.

In addition, the provision of the slot allows the cassette 1 to be maintained in the supporting plate when the supporting plate 4 is turned upside down which may occur e.g. when the supporting plate 4 forms part of a continuous conveyer belt.

Preferably, the close contact is established by the resilient or flexible material exerting a firm grip on the part of the supporting plate 4 being received in the slot 5. Such a firm grip is preferably dimensioned so at to provide a seal between the resilient or flexible material and the supporting plate.

While it is preferred to form the cassette only from a resilient or flexible material, a cassette may be made from a combination of materials. In such embodiments, at least the support surface 3 of the cassette 1 is formed by the resilient or flexible material. Thus, in preferred embodiments, the resilient or flexible material forms part of the cassette.

While the above disclosed cassette allows for receiving a cup or container of a certain size matching the opening 2 of the cassette 1 with the flange of the cup or container resting on the support surface 3, a production facility could benefit from being able to handle cups or container with another dimension than what the cassette 1 is designed for. In such case, the device according to the present invention may further comprise a reducing cassette 7 as shown in FIG. 4.

Such a reducing cassette 7 has an opening 10 in an axial direction of the reducing cassette 7 and a support surface 11 transverse to the axial direction and extending around the opening 10. The opening 10 of reducing cassette 7 is smaller than the opening 2 of the cassette 1 and is capable of receiving a cup or container in the opening with a outwardly extending flange of the cup or container supported by the support surface 11. As shown, the reducing cassette 7 is received in the opening of the first cassette.

Figure 4:
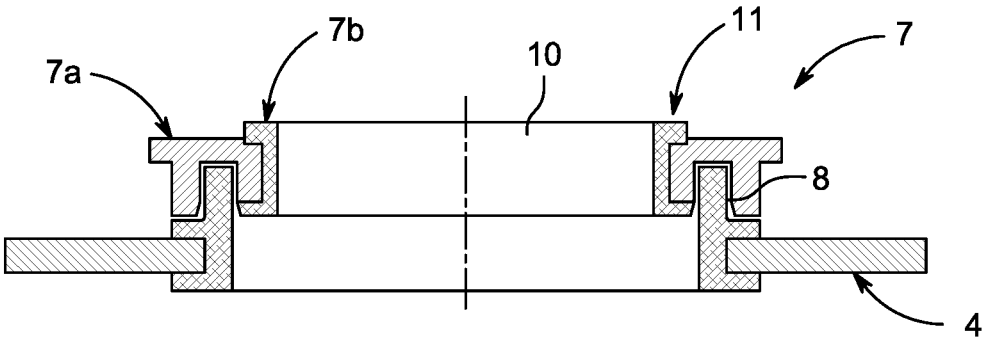
FIG. 4 shows a preferred embodiment of a reducing cassette in cassette according to the present invention.

As shown in FIG. 4, the reducing cassette 7 is preferably made from two parts, a first part 7*a* which preferably is formed by a non-resilient or non-flexible material, such as metal (e.g. stainless steel) and a resilient or flexible part formed by a resilient or flexible material such as rubber. The part 7*b* is referred to as a lining herein. However, the reducing cassette 7 may be formed solely from a resilient or flexible material.

The reducing cassette 7 shown in FIG. 4 comprising a slot 8 in which a part of the part of the cassette 1 comprising the support surface 4 of the cassette 1 is received. As introduced above, the reducing cassette 7 comprises a lining 7*b* formed by a resilient or flexible material, and the lining 7*b* further forms the support surface (11).

Figure 5:
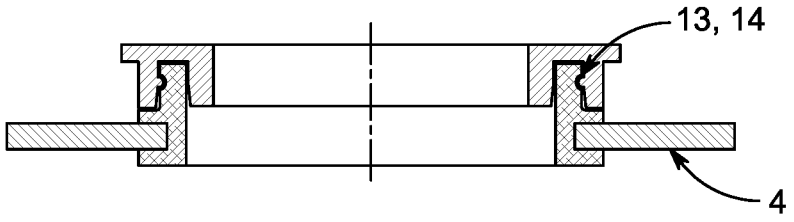
FIG. 5 shows a further preferred embodiment of a reducing cassette in a cassette according to the present invention

Reference is made to FIG. 5 which shows a reducing cassette 7 where no lining 7*b* is applied (although it is within the scope of the invention to apply such a lining 7*b*). In the embodiment of FIG. 5, the reducing cassette 7 comprising a latch 13 engaging with a groove 14 provided in the cassette 1 in order to maintain the reducing cassette 7 in latched position in the cassette 1. This is advantageous e.g. if the supporting plate 4 is turned upside down as disclosed above.

Preferably, the opening of a cassette 1 according to the present invention is a centrally arranged opening, which opening may be annular for receiving cups of container having a circular cross section. Further, the opening of the reducing cassette 7 is a centrally arranged opening, which may be annular. It is noted that the shape of the opening of a cassette or reducing cassette is selected to match the cross section of the cup or container to be received in the opening, and that for instance the cassette may be formed to match e.g. a cup having a rectangular cross section and the reducing cassette may be formed to match a cup with a circular cross section. In such embodiments, the outer shape of the reducing cassette 7 may be rectangular to mimic the shape of the opening 2 in the cassette 1 while the opening 10 in the reducing cassette is circular to receive a cup with a circular cross section.

In a particular preferred embodiment, the device is a filling device comprising a conveyer and a plurality of cassettes as disclosed herein and the supporting plate 4 forms at least a part of the conveyer, so that the conveyer conveys a cassette arranged in the opening of the supporting plate 4. Such a filing device may further comprise a plurality of reducing cassettes 7 as disclosed herein.

Figure 6:
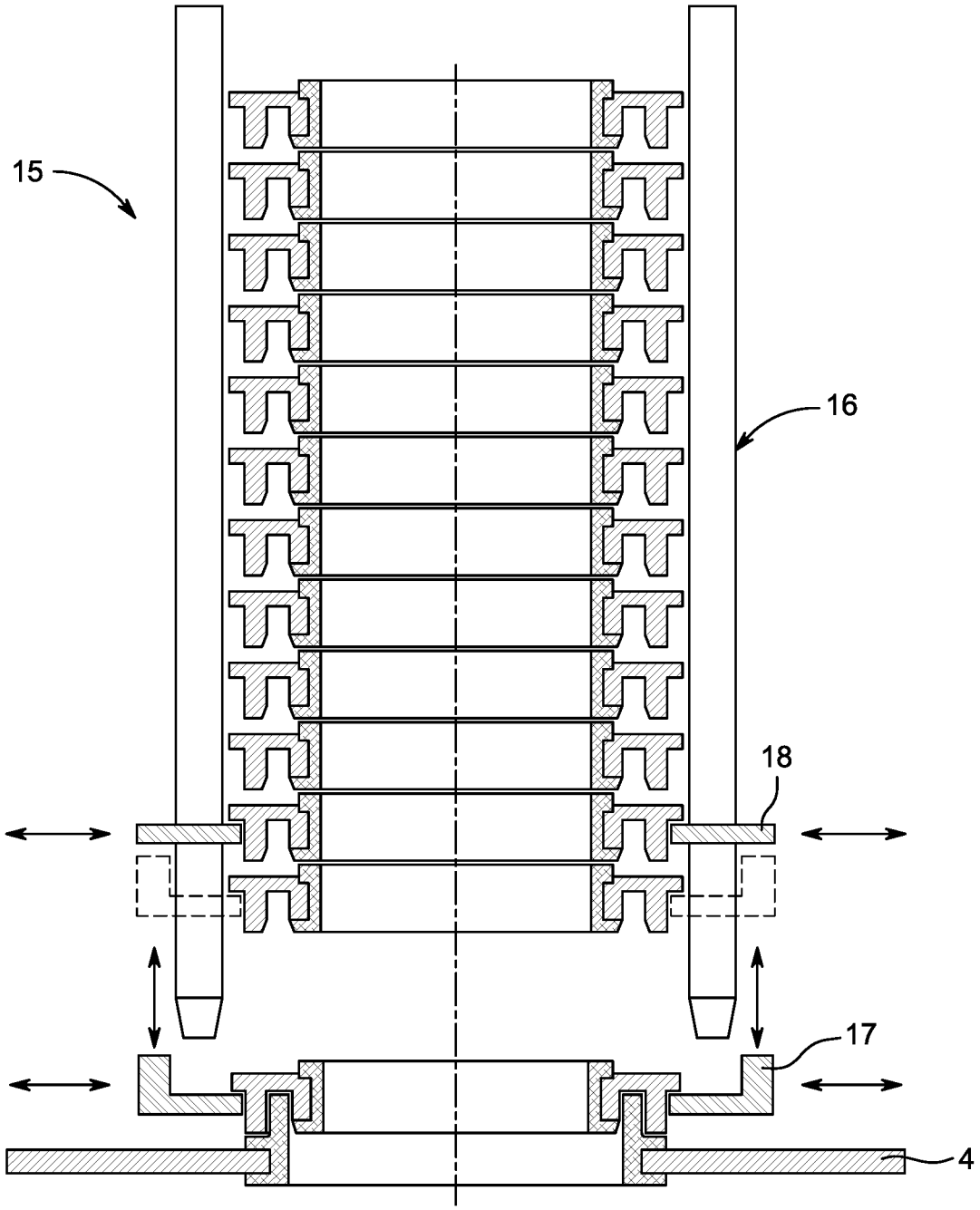
FIG. 6 shows a preferred embodiment of a cassette/reducing cassette magazine and shows schematically dispensing of a cassette/reducing cassette.

In order to allow for easy application of reducing cassettes 7 the filling may further comprise a dispenser 15 as disclosed in FIG. 6. The dispenser is typically used for dispensing a reducing cassette 7 into the opening of a cassette 1 arranged in the opening the supporting plate 4.

As shown in FIG. 6, the dispenser 15 comprising a magazine element 16 arranged with its axial direction substantially transversal to a conveying direction of the conveyer. The magazine element 16 may be formed by a number of rods, a tubular element or the like and is adapted to house the reducing cassettes 7 in a stack as disclosed in FIG. 6 so as to form a magazine of reducing cassettes 7. In FIG. 6 double arrows indicates an element's movement and hatched contours indicates another position element 17.

The dispenser also comprising a device 17 for moving a single reducing cassette 7 from a stack of reducing cassettes arranged inside the magazine element 16 into the opening 2 of a cassette 1, and for retracting a reducing cassette 7 from a cassette 1 and arranging the retracted reducing cassette 7 in magazine element 16. The stack of reducing cassettes 7 is kept inside the magazine element 16 by the stack support 18.

Although the present invention has been described in connection with the specified embodiments, it should not be construed as being in any way limited to the presented examples. The scope of the present invention is set out by the accompanying claim set. In the context of the claims, the terms "comprising" or "comprises" do not exclude other possible elements or steps. Also, the mentioning of references such as "a" or "an" etc. should not be construed as excluding a plurality. The use of reference signs in the claims with respect to elements indicated in the figures shall also not be construed as limiting the scope of the invention. Furthermore, individual features mentioned in different claims, may possibly be advantageously combined, and the mentioning of these features in different claims does not exclude that a combination of features is not possible and advantageous.

The invention claimed is:

1. A device comprising a cassette having an opening in an axial direction of the cassette and a support surface transverse to the axial direction and extending around the opening of the cassette, the cassette being configured to receive a cup in the opening with an outwardly extending flange of the cup supported by the support surface, and a supporting plate having an opening in a normal direction of the supporting plate, the cassette comprising a resilient or flexible material, and wherein the cassette further comprises:

a slot in which a part of the supporting plate is received in close contact without cavities, wherein the close contact is established by the resilient or flexible material exerting a firm grip on the part of the supporting plate being received in the slot.

2. The device according to claim 1, wherein the close contact established by the resilient or flexible material exerting the firm grip is dimensioned so as to provide a seal between the resilient or flexible material and the supporting plate.

3. The device according to claim 1, wherein the support surface of the cassette is formed by the resilient or flexible material.

4. The device according to claim 1, wherein the cassette is formed by the resilient or flexible material.

5. The device according to claim 1, wherein the resilient or flexible material forms part of the cassette.

6. The device according to claim 1, wherein the opening of the cassette is a centrally arranged annular opening.

7. The device according to claim 1, wherein the device further comprises a reducing cassette having a central opening in an axial direction of the reducing cassette and a support surface transverse to the axial direction and extending around the central opening of the reducing cassette, wherein:

the central opening of the reducing cassette is smaller than the opening of the cassette and is configured to receive a cup or container in the opening of the reducing cassette with an outwardly extending flange of the cup or container supported by the support surface of the reducing cassette, and the reducing cassette being received in the opening of the cassette.

8. The device according to claim 7, wherein the reducing cassette comprises a slot in which a part of the cassette is received.

9. The device according to claim 7, wherein the reducing cassette further comprises a lining formed by a resilient or flexible material, said lining further forming the support surface.

10. The device according to claim 7, wherein the reducing cassette comprises a latch engaging with a groove in the cassette to maintain the reducing cassette in latched position in the cassette.

11. The device according to claim 7, wherein the opening of the reducing cassette is a centrally arranged annular opening.

12. A filling device comprising a conveyer and the device as set forth in claim 1, wherein the supporting plate forms at least a part of the conveyer, so that the conveyer conveys a cassette arranged in the opening of the supporting plate.

13. The filling device according to claim 12, wherein the filling device further comprises a plurality of reducing cassettes.

14. The filling device according to claim 13, wherein the filling device further comprises a dispenser for dispensing a reducing cassette into the opening of a cassette arranged in the opening of the supporting plate.

15. The filling device according to claim 14, wherein the dispenser comprises:

a magazine element arranged with an axial direction of the magazine element substantially transversal to a conveying direction of the conveyer, and a device for moving a single reducing cassette from a stack of reducing cassettes arranged inside the magazine element into the opening of a cassette, and retracting a reducing cassette from a cassette and arranging the retracted reducing cassette in magazine element.

* * * * *